United States Patent [19]

Port et al.

[11] Patent Number: 4,580,435

[45] Date of Patent: Apr. 8, 1986

[54] INSTALLATION TOOL FOR PULL TYPE FASTENERS

[75] Inventors: Gary L. Port, Glenford; Michael J. Himes, Woodstock; John J. Kaelin, Saugerties, all of N.Y.

[73] Assignee: Huck Manufacturing Company, Irvine, Calif.

[21] Appl. No.: 576,861

[22] Filed: Mar. 5, 1984

[51] Int. Cl.[4] ..... B21J 15/34

[52] U.S. Cl. ..... 72/391; 72/453.17

[58] Field of Search ..... 72/391, 453.17, 453.19; 29/243.53

[56] References Cited

U.S. PATENT DOCUMENTS

| | | | |
|---|---|---|---|
| 3,088,618 | 5/1963 | Pickford | 72/391 |
| 4,118,969 | 10/1978 | Corbett | 72/391 |
| 4,454,746 | 6/1984 | Schwab | 72/453.17 |
| 4,515,005 | 5/1985 | Klein | 72/391 |
| 4,517,820 | 5/1985 | Oefinger et al. | 72/391 |

FOREIGN PATENT DOCUMENTS

| | | | |
|---|---|---|---|
| 1300504 | 8/1969 | Fed. Rep. of Germany | 72/453.17 |
| 2457857 | 6/1975 | Fed. Rep. of Germany | 72/391 |

*Primary Examiner*—Francis S. Husar
*Assistant Examiner*—David B. Jones
*Attorney, Agent, or Firm*—Harness, Dickey & Pierce

[57] ABSTRACT

An installation tool, for setting fasteners by applying a relative axial pulling force via a nose assembly to the fastener, and having a pneumatic means operable from a low pressure to provide a high pressure to a hydraulic means via an intensifier means, with the pneumatic means being constructed of a molded lightweight plastic having the pneumatic circuits molded therein, and with the hydraulic means constructed of a different material, and including hydraulic surge dampener means and a generally, open in line hydraulic circuit, and having a removable wiper housing facilitating the use of different nose assemblies.

20 Claims, 6 Drawing Figures

INSTALLATION TOOL FOR PULL TYPE FASTENERS

BACKGROUND AND SUMMARY OF THE INVENTION

The present invention relates to tools for installing pull type fasteners and more particularly to such tools which are pneumatically-hydraulically actuated.

The installation tool of the present invention is designed for use in setting two piece fasteners. The specific embodiment shown and described herein was designed for the installation of two piece blind fasteners such as that described in the co-pending U.S. patent application of W. Smith for "Two Piece Blind Fastener with Lock Spindle", Ser. No. 425,304, filed on Sept. 28, 1982. In the installation of such fasteners, it is desirable to have an installation tool which is compact and of a lightweight construction. While the use of plastic materials in the construction of such tools would be desirable in reducing weight, it is difficult to provide satisfactory seals and mechanically stressed connections in high pressure areas. In the present invention the installation tool has its housing and low pressure cylinder constructed of a lightweight plastic material and its high pressure cylinder constructed of ferrous or aluminum materials.

Two piece fasteners of the type noted are set by a relative pulling force between a pin and a sleeve or collar. Installation is completed when the pin is finally severed at a breakneck groove by the pulling force from the tool. At pin break, the loads built up in the tool could result in internal shock and vibration. In the present invention this shock is substantially eliminated by the use of a fluid dampening device.

In applying a fastener a nose assembly is secured to the tool. One type of nose assembly for setting lockbolts is shown in U.S. Pat. No. 4,347,728 issued Sept. 7, 1982 to W. Smith for "Apparatus and System for Setting Fasteners". A variation of the above nose assembly could be used for non-swage type, blind fasteners (of the type shown in the noted co-pending application). Thus in applying different types and sizes of fasteners it is common to utilize a variety of adaptors and/or entirely new subassemblies to accommodate different nose assemblies. In the construction of the present invention, the tool, being of a simple construction, can be readily disassembled and the replacement of only a single component can accommodate a number of different nose assemblies for setting a variety of fasteners.

The tool of the present invention utilizes low, pneumatic pressure to provide a significantly higher hydraulic working pressure which provides the necessary reciprocating pull force to the nose assembly for installing the fastener. The desired reciprocation selectively occurs in response to actuation of an air directional valve and a network of air logic passages. In the present invention the air directional valve is supported in a plastic housing which is connected to a plastic main housing of the tool. The air logic passages are substantially defined in the housings by molded grooves and ports. The latter design results in a generally inexpensive structure since, expensive secondary machinery operations are nearly completely eliminated.

In tools having hydraulic circuits the hydraulic fluid may have to be periodically replenished. In the present invention a generally straight fill path is provided with a large access in the pull cylinder to facilitate filling while inhibiting air entrapment.

Therefore, it is an object of the present invention to provide a new and unique pneumatic-hydraulic fastener installation tool being of a compact and lightweight construction.

It is another object of the present invention to provide a fastener installation tool of the above described type having a fluid dampening device to minimize internal shock and vibration at pin break.

It is still another object of the present invention to provide a fastener installation tool which can be readily adapted to accept different nose assemblies for setting different fasteners.

It is another object of the present invention to provide a fastener installation tool having a main air cylinder housing and air directional valve housing both made of a lightweight plastic and having a plurality of molded grooves and ports co-operating to define a network of air logic passages.

It is another object of the present invention to provide a pneumatic-hydraulic fastener installation tool having a construction facilitating filling with hydraulic fluid while inhibiting air entrapment.

It is a general object of the present invention to provide a new and improved pneumatic-hydraulic fastener installation tool.

Other objects, features, and advantages of the present invention will become apparent from the subsequent description and the appended claims, taken in conjunction with the accompanying drawings, in which:

Figure 1:
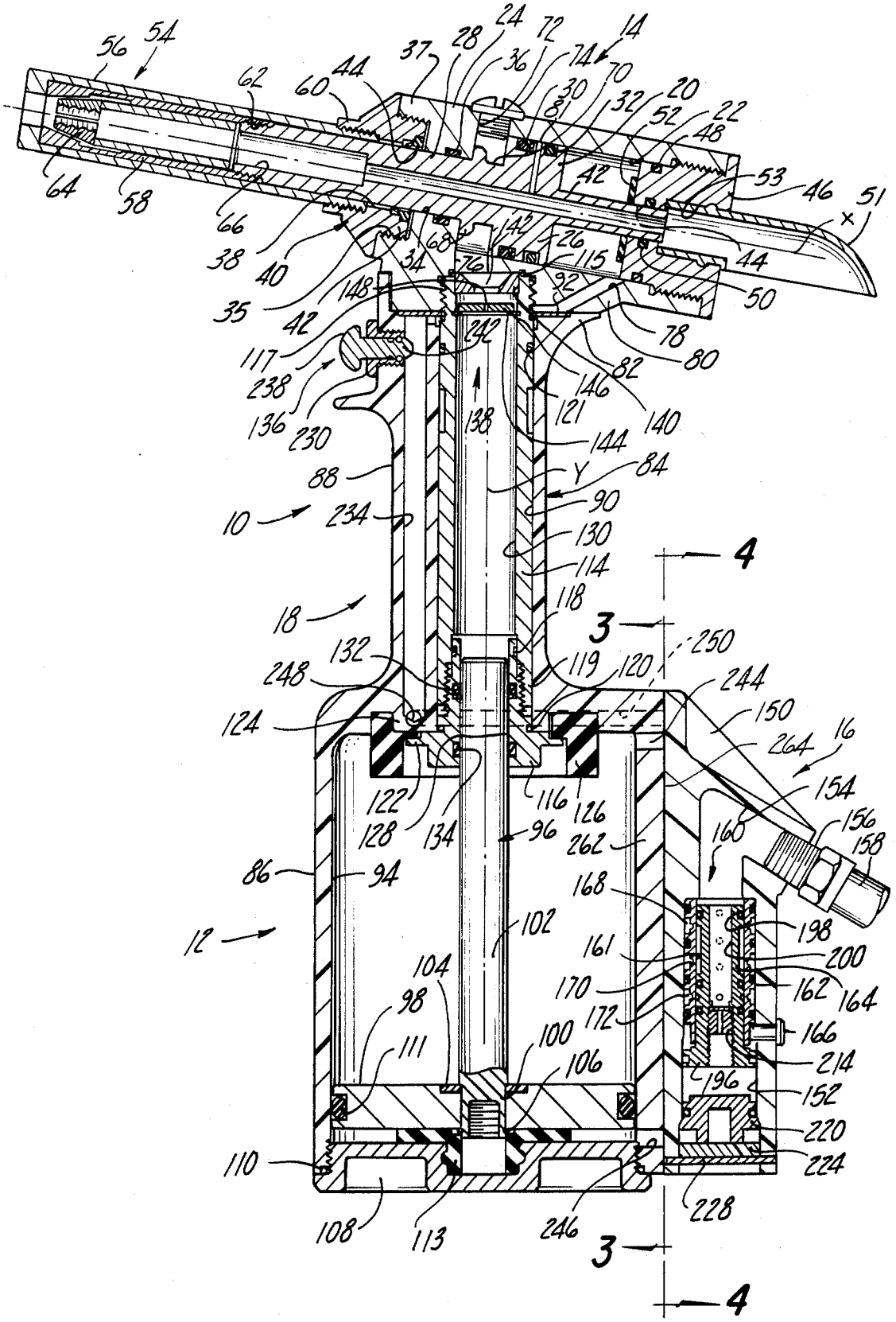
FIG. 1 is a side elevational, sectional view of a pneumatic-hydraulic installation tool embodying features of the present invention and including an air directional valve in a condition placing the tool in its return or idle state.

Looking now to FIG. 1 a pneumatic-hydraulic installation tool 10 and generally includes a pneumatic piston-cylinder section 12, an intensifier section 18, a hydraulic piston-cylinder section 14 and an air directional, logic section 16. In operation the hydraulic piston-cylinder section 14 is operatively connected with the pneumatic piston-cylinder section 12 via the hydraulic intensifier section 18 such that actuation of the pneumatic section 12 at a relatively low pneumatic pressure will in turn cause actuation of the hydraulic section 14 at relatively high hydraulic pressure. The selective actuation of the air directional section 16 will control the actuation of the pneumatic section 12 and hence of the hydraulic section 14.

Thus the hydraulic section 14 includes a pull piston 20 mounted in a cylinder cavity 22 formed in a hydraulic cylinder housing 24 for reciprocating motion along a longitudinal axis X. For purposes of description, the axis X can be generally considered to be horizontal although slightly inclined relative to a vertical axis Y of the tool 10. Pull piston 20 has an enlarged piston head portion 26 and a forwardly extending reduced diameter pull rod portion 28. A pair of axially spaced annular seals 30 and 32 are located in annular grooves in head portion 26 to provide hydraulic and pneumatic sealing, respectively, with the wall of cylinder cavity 22. As will be seen, the forward or rod end of cylinder cavity 22 is adapted to receive hydraulic fluid under high pressure to effectuate a pull stroke of the piston 20 while the rearward or head end of cavity 22 is adapted to receive relatively low pneumatic pressure to effectuate the return movement of the piston 20. In one design the pneumatic pressure was approximately 90 psi while the intensified hydraulic pressure was 3800 psi.

The piston rod portion 28 extends axially through and substantially beyond a stepped bore including a smooth inner bore 34 and an enlarged threaded bore 35 in the front wall 37 of the cylinder housing 24; a hydraulic seal 36 in bore 34 provides a hydraulic seal with rod portion 28.

The rod portion 28 extends axially through a stepped bore 38 in a wiper housing 40. Housing 40 has a rearward reduced diameter portion 42 which is threadably secured to the forward enlarged bore 35 in cylinder front wall 37. An annular wiper ring 44 is located in a groove at the rear of stepped bore 38 and is adapted to annularly embrace the rod portion 28 to keep dirt and dust out from the forward hydraulic seal 36. As will be seen the wiper housing 40 performs other valuable functions.

A tail portion 42 extends axially, rearwardly from piston head 26 and is adapted to extend through a reduced diameter bore portion 44 in an end cap 46. Cap 46 is threadably secured to the rearward end of cylinder housing 24. An outer seal 48 and an inner seal 50 in cap 46 provide a pneumatic seal between the cylinder cavity 22 and piston tail portion 42, respectively. The end cap 46 has a tubular deflector 51 secured to and extending rearwardly from an enlarged bore portion 53 in cap 46.

An annular washer like bumper 52 is located about the piston tail portion 42 and against the inside of cap 46; bumper 52 is made of a resilient material and acts to cushion the impact of piston 20 when it reaches its rearward most, bottomed out position.

A nose assembly 54, representatively shown, includes an outer anvil 56 and an inner collet assembly 58. The outer anvil 56 is threadably secured to an enlarged bore portion 60 of stepped wiper bore 38 while the collet assembly 58 is threadably secured to the piston rod end 62. Thus as pull piston 20 reciprocates it will similarly reciprocate the collet assembly 58 within the outer anvil 56. The collet assembly 58 includes a plurality of jaws 64 adapted to grip the pin of the fastener to be set while the anvil 56 is adapted to engage the fastener sleeve or collar (see the U.S. Pat. No. 4,347,728 patent to Smith, supra). The reciprocating action applied between the collet assembly 58 and anvil 56 results in a relative axial force applied to the fastener whereby it is set and the pin portion of the pin is severed. When this occurs the severed pull portion can travel rearwardly through the collet assembly 58 and through a central bore 66 through pull piston 20 and out through deflector 51. Deflector 51 directs the severed pin portion downwardly.

As noted, in order to drive different fasteners, a different nose assembly may be required. With some prior tool constructions, this would require the use of adaptors or even the replacement of the part or all of the hydraulic section 14. With the present invention a variety of nose assemblies can be accommodated simply by changing the wiper housing 40 to one which can accommodate the new nose assembly.

The removable wiper housing 40 provides other advantages. In some prior constructions, the structure represented by the wiper housing 40 would be an integral part of the hydraulic housing 24. Because of the forces encountered in the connection between the anvil (such as 56) and the hydraulic housing this connection could become damaged or worn requiring replacement of the entire hydraulic housing. With the present invention, only the wiper housing 40 need be replaced under those circumstances. It also should be noted that since the wiper housing 40 is removably located in a relatively deep counterbore 35, access for installation and/or replacement of the front hydraulic seal 36 is facilitated.

The piston head 26, terminates at its forward end in a reduced diameter stop portion 68 which is adapted to engage the inside of front wall 37 when the piston 20 is in its forwardmost or return position as shown in FIG. 1. An annular groove 70 separates the stop portion 68 from the remainder of the piston head 26. Groove 70 has a diameter generally equal to that of the piston rod portion 28 and is axially located to be substantially in radial alignment with the axis of a fluid fill bore 72. The bore 72 threadably receives a removable fill cap 74. As will be seen, by locating the groove 70 in line with the fill bore 72, the bore 72 is substantially freely opened to the cylinder cavity 22 thereby facilitating filling while inhibiting air entrapment.

The hydraulic housing 24 has a hydraulic port 76 generally located diametrically opposite from the fill bore 72 and hence in line with the piston groove 70. As will be seen this straight alignment of port 76, fill bore 72 and piston groove 70, generally along the vertical axis X, facilitates filling the hydraulic circuit. A pneumatic port 78 communicates the rearward or return side of cylinder cavity 22 through the base 80 of hydraulic housing 24. A radially extending cross port 81 in piston head 26 is located between seals 30 and 32 and communicates with the piston bore 66. This permits the escape to the atmosphere of fluid leaking past either of the seals 30, 32.

Because of the pressures and forces encountered by the hydraulic section 14 the structural components such as the hydraulic housing 24, the pull piston 20 and the wiper housing 40 are of a metallic construction.

The base 80 of hydraulic housing 24 is adapted to be seated upon an upper platform portion 82 of a pneumatic housing 84. The pneumatic housing 84 has a relatively large diameter or cross-sectioned pneumatic cylinder portion 86 and relatively narrow cross sectioned neck or handle portion 88 which terminates in the platform portion 82. In order to provide a lightweight construction, the pneumatic housing 84 is constructed of a molded plastic. In one form of the invention the plastic material was ZYTEL 77G33L, Nylon 6/12 with ½% foam, and 30% glass filled. ZYTEL is the trademark of E. I. duPont de Nemore & Co. (Inc.).

The neck 88 is tubular and has a generally oblong section with the major diameter shown in FIG. 1 and with the minor diameter extending into the plane of the paper. A central, circular through bore 90 terminates at its upper end with an annular stepped groove 92 and at its lower end at a pneumatic cylinder cavity 94.

A pneumatic piston 96 is reciprocably supported within cylinder cavity 94 and has a piston head 98 secured to a reduced diameter end 100 of a piston rod 102 via a bearing washer 104 and a retaining ring 106. A cap 108 threadably closes the lower, open end of cylinder cavity 94 with a seal 110 providing an appropriate pneumatic seal. Another seal 111 in piston head 98 provides a pneumatic seal separating the cylinder cavity 94 on opposite sides of the cylinder head 98.

A lower bumper 113 of resilient material has a stepped construction which is partially matably received within a recess in the cap 108. Bumper 113 cushions the impact of piston 96 when it is moved to its lowermost or return position as shown in FIG. 1.

The piston rod 102 extends upwardly into the confines of the handle through bore 90 and defines a part of the hydraulic intensifier section 18.

The intensifier section 18 includes a long tubular, sleeve 114 which is threadably secured to the hydraulic housing 24 at an enlarged bore 117 in its base 80. A seal 115 provides a seal between sleeve 114 and hydraulic housing base 80. The sleeve 114 extends co-axially in clearance relationship through the handle bore 90; a seal 121 in sleeve 114 provides a pneumatic seal with the handle bore 90. A gland nut 116 is threadably connected with the lower end 119 of the sleeve 114. A hydraulic seal 118 is located in a cylindrical portion of gland nut 116 and provides a hydraulic seal with sleeve 114. A pneumatic seal 120 is located in a lower groove in the nut 116 to provide a seal with the handle bore 90. The gland nut 116 has an enlarged flange 122 which is engageable with a shoulder 124 at the base of handle bore 90 within the pneumatic cavity 94. The sleeve 114 and gland nut 116 are of a metallic construction as is the housing 24. Thus the hydraulic assembly including the housing 24, the sleeve 114 and gland nut 116 will be securely clamped to the plastic handle portion 88 via the handle platform 82 and the shoulder 124. The threaded connections as at the upper bore 117 and lower end 119 are between metal structures and not plastic to plastic or plastic to metal, thus providing for a more satisfactory and durable connection to resist separating forces created when the intensifier section 18 is pressurized in a manner to be described.

An annular, upper piston bumper 126 is located in a recess in the housing shoulder 124 and is held or clamped in place by a stepped portion in gland nut flange 122. The bumper 126 is made of a resilient material and cushions the force of the pneumatic piston 96 when it is moved to its uppermost position.

The gland nut 116 has a central bore 128 which is coaxial with and slightly smaller in diameter than the inside diameter of cylinder cavity 130 of sleeve 114. The piston rod 102 is adapted to be received for reciprocable movement within gland nut bore 128. A seal 132 is located in an upper annular groove in bore 128 to provide a hydraulic seal with the piston rod 102. Similarly, a seal 134 is located in a lower annular groove in bore 128 to provide a pneumatic seal with piston rod 102.

The installation tool 10 in FIG. 1 is shown in its return condition. In this condition a trigger assembly 136 is in its deactuated condition (as shown), in which pneumatic pressure is applied to the rod or return side of pneumatic cylinder 94 and to the return side of cylinder 22. In order to energize the tool 10 to install a fastener, the trigger assembly 136 is actuated to apply pneumatic pressure to the head side of pneumatic cylinder 94 while the rod side of cylinder 94 and return side of cylinder 22 are exhausted to atmosphere. Now the piston 96 moves upwardly moving the piston rod 102 into the intensifier cylinder cavity 130 pressurizing the hydraulic fluid therein to pressurize the pull side of cylinder 22 to urge the pull piston 20 rearwardly. The result is the application of a relative axial force between the pin and sleeve (or collar) of the fastener via nose assembly 54 to set the fastener. The above actuation of tool 10 occurs via the trigger assembly 136, the air directional section 16 and its associated air logic circuitry in a manner to be described.

Since the pneumatic system is designed to operate from a low air pressure source (90 psi in one case) and a high hydraulic pressure is desired to actuate the hydraulic section 14 (3800 psi in one case), the cross-sectional areas of the pneumatic piston head 98 and the face of the piston rod 102 extending into the intensifier cylinder cavity 130 are adjusted accordingly. As noted, in view of the high magnitude of hydraulic pressure, the entire hydraulic circuit and intensifier is of a metallic construction which in effect defines a separate subassembly from the pneumatic circuit and housing components which, as indicated, are of a molded plastic construction. Thus the loads resulting from the high hydraulic pressure are essentially reacted through the metallic components and not the plastic components. Note that the loads transmitted from the gland nut 116 to the shoulder 124 are via a clamped, not threaded, connection and are distributed over a relatively wide area.

The installation of the fastener is completed when the relative axial force applied by the tool 10 via nose assembly 54 has attained a sufficiently high magnitude to sever the pull portion of the pin. When this occurs, the pull piston 20 tends to move rapidly rearwardly. The result can be a severe internal shock and vibration. The latter is inhibited by the use of a hydraulic damper assembly 138. The damper assembly 138 is located at the upper end of the intensifier sleeve 114 and includes an annular seat 140 fixedly supported in a counterbore at the end of sleeve 114. The annular seat 140 has a through bore 142 which is straight at the lower end and flares outwardly at the upper end. The straight portion of bore 142 is substantially the same diameter as hydraulic port 76. The damper assembly 138 includes a movable disk 144 which is axially supported by a retaining ring 146 in clearance relationship relative to the side walls of intensifier cavity 130. The disk 144 has a restrictive orifice or opening 148. In normal operation during a pull stroke, i.e. piston rod 102 moving into intensifier cavity 130, hydraulic fluid can be moved through the orifice 148 and around the disk 144 and retaining ring 146. The retaining ring 146 is slotted and hence some flow is permitted between the disk 144 and retaining ring 146. As the flow rate increases the disk 144 can be easily lifted from the retaining ring 146 to maximize the cross-section of the flow path. In the latter condition, the total cross-section available through and around the disk 144 is approximately equal to that of the straight portion of bore 142. Upon pin break a surge of fluid flow will occur moving the disk 144 momentarily against the seat 140 leaving substantially only the restricted orifice 148 to transmit fluid to the pull side of cylinder 22. This restricts the flow of fluid resulting in a dampening of the internal shock and vibration. In one form of the invention, the orifice 148 was selected to provide an opening substantially restricting the volume of flow of fluid to around ten percent of its unrestricted volume.

From FIG. 1, it can be seen that the fill path for hydraulic fluid from the fill bore 72 through the pull cylinder 22, hydraulic port 76 and bore 142 to the intensifier cavity is generally a straight line; this facilitates filling, including replenishing, and assists in minimizing air entrapment.

As noted actuation of the tool 10 is controlled by the trigger assembly 136, the directional valve section 16 and its associated pneumatic logic circuit. Thus the tool 10 is placed in its return condition when the trigger section 136 and directional valve assembly 16 are in the state shown in FIGS. 1 and 1A and is placed in its pull condition when the trigger section 16 is actuated to place the directional valve section 16 in the position shown in FIG. 2.

Figure 1A:
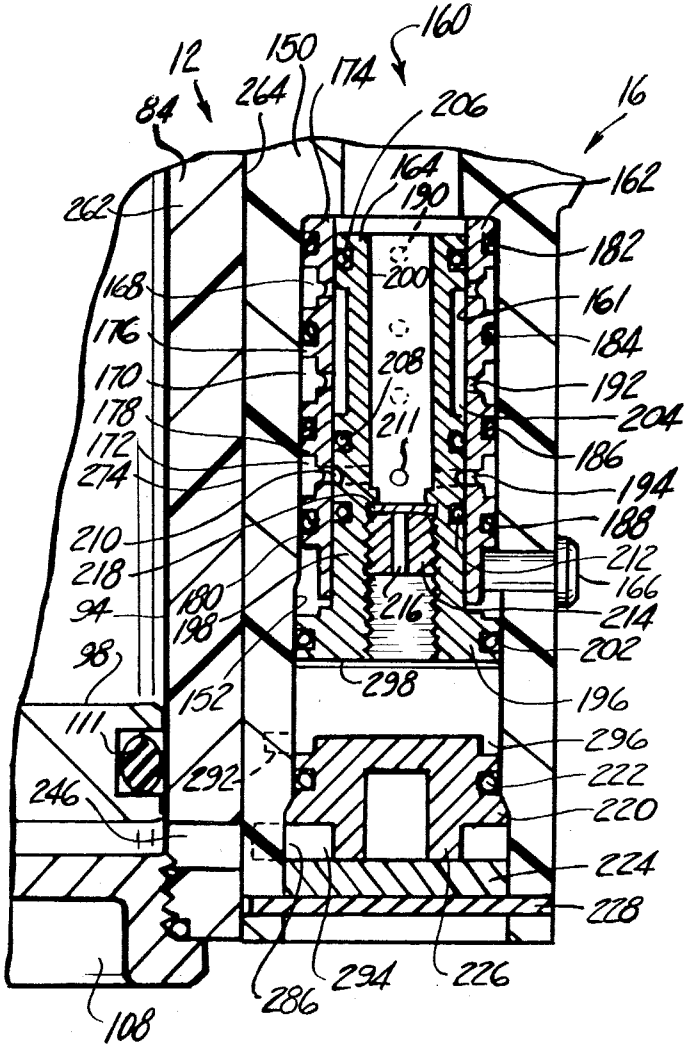
FIG. 1A is a fragmentary, sectional view to increased scale of the air directional valve of FIG. 1.
Figure 2:
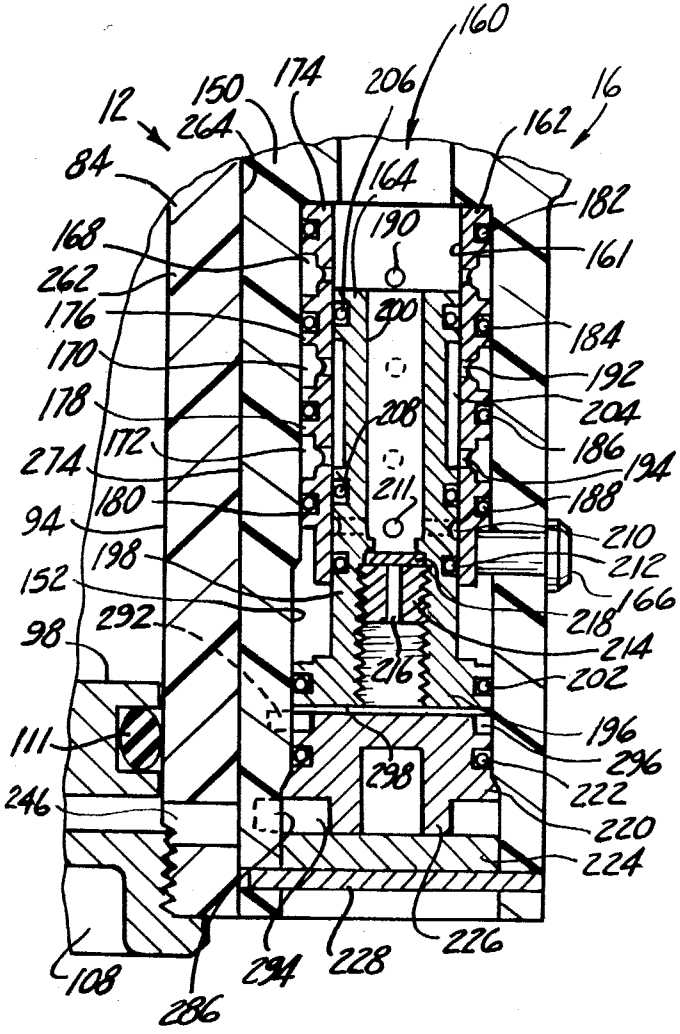
FIG. 2 is a fragmentary, sectional view to increased scale showing the air directional valve in a condition placing the tool in its power or pull state.

Looking now to FIGS. 1, 1A and 2, the directional valve section 16 includes a housing 150 which is preferably constructed of a lightweight molded plastic similar to that of pneumatic housing 84. Valve housing 150 has a generally vertically extending stepped bore 152 communicating with an elbow bore portion 154 which can be connected to a source of pneumatic pressure via a fitting 156 and line 158. An air directional valve 160 is located in stepped bore 152 and includes an outer sleeve 162 and an inner spool 164. While the sleeve 162 is held from movement via a pin 166, spool 164 can slide within a central bore 161 in sleeve 162. In the description of the air directional valve 160 more of the detail numerals are applied to FIGS. 1A and 2 for clarity and convenience.

The sleeve 162 has three annular grooves 168, 170 and 172 separated by lands 174, 176, 178 and 180 each of which has a pneumatic seal 182–188, respectively, to seal the grooves 168–172 from each other. Each groove 168–172 are communicated with the sleeve bore 161 via radially extending cross ports 190, 192 and 194, respectively.

The spool 164 is generally cylindrical and has a head portion 196 of a size adapted to be slidably received in bore 152 and a reduced diameter body portion 198 adapted to be similarly received in sleeve bore 161. The spool 164 is tubular having a central through bore 200. A seal 202 in a groove in head portion 196 provides a pneumatic seal with bore 152.

An elongated annular groove 204 is formed on the outer surface and at the upper end of the spool 164 and is sealed at its opposite ends with sleeve bore 161 via annular pneumatic seals 206 and 208. Another, but substantially narrower, annular groove 210 is located in the spool outer surface below elongated groove 204 with a pair of seals 208 and 212 at its opposite ends providing a seal with sleeve bore 161. Narrow groove 210 communicates with the central spool bore 200, and hence with sleeve bore 161 and housing bore 152, via radial cross ports 211.

A cap 220 is located at the lower end of bore 152 and has a construction matching the stepped construction of bore 152 whereby it will be positioned at a preselected location. An annular seal 222 in cap 220 provides a seal with bore 152. A pneumatic muffler 224 matably fits within bore 152 and is held in place against an annular boss 226 on cap 220 via a cylindrical roll pin 228 which extends diametrically across muffler 224 whereby air can escape through muffler 224 past pin 228 to the atmosphere.

The lower end of spool bore 200 is threaded and threadably receives an air restrictor 214 which permits restricted air flow via a small diameter through bore 216. The restrictor 214 also holds a permeable air filter 218 in place against a shoulder in a sleeve bore 200.

As will be seen the operational position of the air directional valve 160, and hence the condition of tool 10, is controlled by the operator via actuation of the trigger assembly 136 located in the tool handle 88. The trigger assembly 136 includes a flanged bushing 230 which is sealingly secured in a cross bore in handle 88 which communicates with a vertically extending passageway 234. The passageway 234 is molded into the handle 88 and extends from the boss 124 upwardly into the stepped groove 92 whereby it can communicate with the pull cylinder 22 via passageway 78. An annular gasket is located in the groove 92 and provides a pneumatic seal between the pull housing 24 and platform 82 whereby the pneumatic circuit to the cylinder 22 will be sealed.

An actuating button 238 is slidably supported within bushing 230 and has a pneumatic seal located inwardly of the bushing 230 on a button stem portion 242. The stem portion 242 defines a clearance with bushing 230 such that when it is pressed inwardly air in the circuits associated with passageway 234 can escape to atmosphere; however, when the trigger button 238 is released the air pressure differential in passageway 234 will move the button 238 outwardly to seal the clearance passage.

As noted the operator will place the tool 10 in either the return or pull condition by actuation of the trigger assembly 136. In the return condition, the spool 164 of air directional valve 160 will be in its upper most position (FIGS. 1 and 1A) while in the pull condition, the spool 164 of air directional valve 160 will be in its lowermost position (FIG. 2). The air directional valve 160 will then operate on the pneumatic circuits of the tool 10 to cause actuation to either the return or pull condition. The pneumatic circuits of tool 10 include logic circuits shown in FIGS. 3 and 4 which cooperate with the directional valve 160 to connect the operating circuits either to air pressure or to atmosphere.

Figure 3:
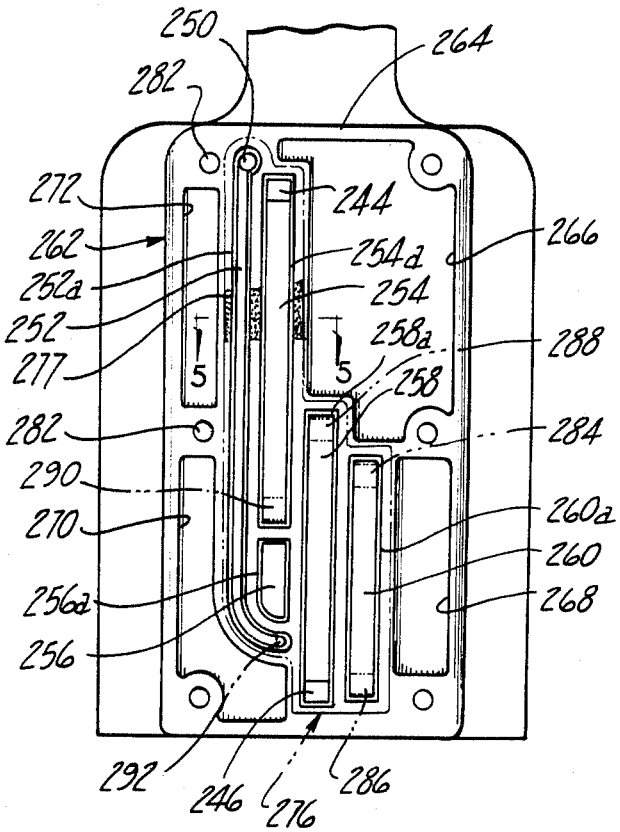
FIG. 3 is a sectional view taken substantially along the line 3—3 in FIG. 1 and depicting the plastic, molded main housing of the tool of FIG. 1 depicting the molded grooves and ports partially defining the air logic network.
Figure 4:
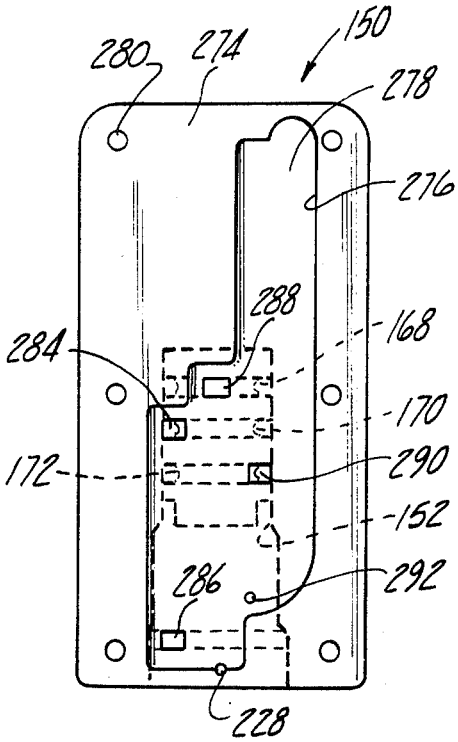
FIG. 4 is a sectional view taken substantially along the line 4—4 in FIG. 1 and depicting the plastic molded housing of the air directional valve and molded porting further defining the air logic network.

The operating circuits are those which connect the pull piston cylinder cavity 22, the trigger assembly 136, and the pneumatic cylinder 94 to the air logic circuits of FIGS. 3 and 4.

Thus the piston rod or return side of pneumatic cylinder 94 is connected to the logic circuits via a port 244 while the piston head or working side of cylinder 94 is connected to the logic circuits via port 246.

The rearward or return side of cylinder cavity 22 and the trigger assembly 136 are connected to the logic circuits via vertical passageway 234 and a pair of horizontally extending passages 248 and 250 which are in quadrature with each other (see FIG. 1). The shoulder 124 extends generally peripherally about the upper end of the wall of pneumatic cylinder 94 with a recess being defined to receive the upper bumper 126. Passage 248 extends from passageway 234 through the shoulder 124 in a direction out of the plane of the paper of FIG. 1. Passage 250, shown in phantom lines, also extends through the shoulder 124 to intersect with passage 248 at a point out of the plane of the paper of FIG. 1. Thus both passages 248 and 250 are completely confined within shoulder 124 with passage 250 communicating with the logic circuits in a manner to be seen.

Looking now to FIG. 3, a series of vertically extending ridged, grooves 252, 254, 258 and 260 define a part of the logic circuits. Another ridged groove 256 is provided for seating and sealing support. Grooves 252–260 are molded to extend inwardly into a side wall 262 of the pneumatic housing 84. The grooves 252–260 have outwardly extending ridges **252*a*–260*a*, respectively, around their peripheries. Thus the ridges 252*a*–260*a* extend outwardly from and above the end surface 264 of side wall 262. A number of cavities such as 266–272 are provided in wall 262** for weight reduction.

Figure 5:
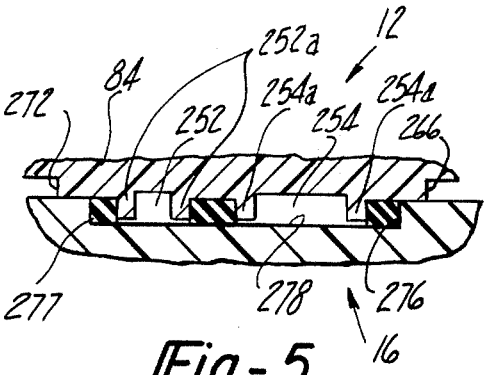
FIG. 5 is a view taken substantially along the line 5—5 of FIG. 3 with mating parts included.

The air directional valve housing 150 (FIG. 4) has a generally planar end surface 274 adapted to overlie the grooved housing surface 264 which also is generally planar. Valve end surface 274 has a recess 276 which generally extends about and receives the grooves 252–260 with a very slight clearance with the recess inner surface 278. The outline of recess 276 is shown in phantom lines in FIG. 3. A sealing gasket 277 (partially shown in FIG. 3) has another contour similar to the valve housing recess 276 and at the same time has openings matching each of the ridges **252*a*–260*a*. Gasket 277 is slightly thicker than the clearance between the housing surface 264 and recess inner surface 278. Thus when the valve housing 150 is secured to the pneumatic housing wall 262 the gasket 277 which is made of a compressible material will deform to sealingly fill the voids between ridges 252*a*–260*a* (see FIG. 5). The seal grooves 252, 254, 258 and 260 now define pneumatically sealed passages. The valve housing 150 is fixed to pneumatic housing wall 262 by way of fasteners (not shown) extending through holes 280 in housing 150 which are in alignment with blind holes 282 in wall 262**.

A plurality of openings or ports 284–292 extend through the recess 276 and communicate with the valve bore 152 and hence with portions of the air directional valve circuitry. Thus port 288 communicates with the upper annular groove 168 in sleeve 162; port 284 communicates with central sleeve groove 170, and port 290 communicates with lower sleeve port 172. Port 286 communicates with the exhaust cavity 294 defined between the cap boss 226 and muffler 224 while port 292 communicates with the cavity 296 between the upper end of cap 220 and the head portion 196 of spool 164. The above can be seen in FIG. 4. Note that the head portion 196 of spool 164 has a cross slot 298 to permit air communication to that surface when the spool 164 is in its lower portion (FIG. 2).

At the inner surface 278 of cavity 294, the port 284 communicates with the upper end of groove or passage 260; at the same time, port 286 communicates with the lower end of passage 260. Port 288 communicates with the upper end of passage 258 and port 290 communicates with the lower end of passage 254 while port 292 communicates with the lower end of passage 252. Ports 284, 286, 288, 290 and 292 are shown in phantom in FIG. 3.

Keeping the above in mind, let us now examine the operating and logic circuits of tool 10 when the tool is in its return or idle condition (see FIGS. 1 and 1A).

Here the trigger button 238 has been released sealing passageway 234 from the atmosphere. Looking now to the air directional valve 160, air pressure from the source is transmitted to bore 152. The air will bleed through the restricted opening 216 in restrictor 214 and establish equal pressures on both ends of the spool 164. Since the cross-sectional area on the lower end of spool 164 is greater than that on the upper end, the spool 164 will be shifted to and held in its upper position (FIG. 1). The elongated spool groove 204 is designed to communicate central sleeve groove 170 with upper groove 168 (with spool 164 in its upper position) or with lower groove 172 (with spool 164 in its lower position). At the same time narrow spool groove 210 will communicate with lower sleeve groove 172 (with spool 164 in its upper position) and will be blocked (with spool 164 in its lower position).

With air directional valve on the upper position of FIG. 1, air pressure from the source will be transmitted to the return or piston rod side of the pneumatic cylinder 94. This will occur via cross ports 211, narrow spool groove 210, lower sleeve groove 172 via ports 194, and port 290 to logic passage 254 and thence port 244 to cylinder 94. This will move the pneumatic piston 96 downwardly for its return stroke, relieving the hydraulic pressure in the intensifier cavity 130 and hence in the pull side of cylinder 22. At the same time the head side of pneumatic cylinder 94 is connected to exhaust through port 246 via logic passage 258. The latter passage is connected to exhaust cavity 294 via port 288, upper sleeve groove 168 and radial ports 190 to elongated spool groove 204 and thence to central sleeve groove 170 via radial ports 192 and thence to logic passage 260 via port 284 and port 286. The air communicated to the exhaust cavity 294 is expelled through muffler 224.

The return side of hydraulic pull piston 20 is also subjected to return air pressure which is transmitted via passage 78, groove 92 and handle passageway 234. The latter passage is connected to the air pressure source via cross passages 248 and 250, logic passage 252, port 292 and the cavity 296 between cap 226 and spool 164. In this state then, the tool 10 will be actuated to and maintained at its return position.

To actuate the tool 10 to install a fastener, i.e. placing it in its pull condition, the operator depresses the trigger button 242 breaking the seal with bushing 230 and permitting air to escape from passageway 234 and hence from the return side of cylinder 22. The pressure is also relieved on the head portion 196 of spool 164 via the port 292, logic passage 252, cross ports 250 and 248, handle passageway 234 and the unsealed trigger assembly 238. When this occurs the pressure drops rapidly in the cavity 296 on the head side of the spool 164 and the restricted opening 216 through restrictor 214 delays and hence precludes the establishment of line pressure on that side of the spool 164. The result is a sufficiently high pressure differential to shift the spool 164 downwardly to the pull position shown in FIG. 2. Now the air pressure is directed to the head side of cylinder 94. This occurs via sleeve cross ports 190 to upper sleeve groove 168, through port 288, to logic passage 258 to port 246 to the pneumatic cylinder 94. At the same time, the rod side of cylinder 94 is now communicated to exhaust. This occurs via port 244, logic passage 254, to port 290 which communicates with lower sleeve groove 172; the groove 172, in turn, is communicated with center sleeve groove 170 via the elongated annular spool groove 204 and thence to logic passage 260 via port 284 and finally to exhaust through port 286, exhaust cavity 224 and muffler 294.

After the installation or pull cycle has been completed, the operator releases the trigger button 242 which is moved to its sealing position by the pressure in passageway 234 and the tool 10 is placed in its return or idle position in the manner previously described.

Thus the tool 10 of the present invention, by providing in a sense a self contained hydraulic unit to react to and carry loads induced by the high pressure the remainder of the tool 10 can be constructed of a lightweight plastic material. In this regard the essential load bearing threaded connections are between metal components while a clamping connection is used to transmit the hydraulic loads to the plastic components. The use of plastic materials permits the integral molding of involved and irregular shapes; at the same time complex logic circuitry defined by the various grooves and ports can be molded with the need for very little secondary machining operations. In the tool 10, only the passages 248 and 250 need be drilled; the remainder of the logic and operating circuits can be formed by molding.

In addition to the above the removable wiper housing 40 lends versatility to the tool 10 to accommodate different nose assemblies and at the same time provides a means for easy and inexpensive replacement in the event of wear or damage.

As noted by having a hydraulic system which is substantially open and on a direct line along the vertical axis of the tool, filling of the tool, while inhibiting air entrapment, is facilitated.

The result is a versatile, compact lightweight installation tool.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. An installation tool, for setting fasteners including a pin and a sleeve by applying a relative axial pulling force between the pin and the sleeve, comprising:

hydraulic means including a hydraulic piston mounted in a first cylinder in a first housing for reciprocation in response to a preselected high hydraulic pressure whereby the relative axial force can be applied to a fastener, pneumatic means including a pneumatic piston mounted in a second cylinder in a second housing for reciprocation in response to a preselected low pneumatic pressure, intensifier means operable in response to reciprocation of said pneumatic piston at said low pressure to provide said high pressure to said first cylinder, said pneumatic piston including a piston head and a piston rod secured thereto, said intensifier means including a third housing having a third cylinder with said piston rod mounted for reciprocable movement therein, said third housing being generally elongated, said third housing having one end mechanically fixed to said first housing with said third cylinder being in fluid communication with one side of said first cylinder, said second housing having a first portion defining said second cylinder and a second portion defining a generally elongated handle, connector means connected to said third housing at its opposite end and engageable with an internal surface within said second cylinder to clampingly engage said handle portion between said first housing and said internal surface with the clamping engagement holding said first and third housings to said second housing, said second, pneumatic housing being made of a molded plastic material, said first and third housing being made of a different material, said installation tool further including pneumatic circuit means comprising operating circuit means for communicating with opposite sides of said first cylinder, air directional valve means having an input adapted to be connected to a source of pneumatic pressure and an output for connection to atmosphere, logic circuit means for connecting said operating circuit means to said valve means and for providing a connection from said valve means to atmosphere, said air directional valve means having a first condition for actuating said tool to apply the relative axial pulling force and to a second condition for actuating said tool to return, and a trigger circuit means selectively actuable to place said air directional valve in said first or said second condition, said valve means being supported in a fourth housing of a molded plastic material, said second and fourth housings having engaging planar surfaces, said logic circuit means being formed by grooves and a plurality of ports in said planar surfaces.

2. An installation tool, for setting fasteners including a pin and a sleeve by applying a relative axial pulling force between the pin and the sleeve, comprising:

hydraulic means including a hydraulic piston mounted in a first cylinder in a first housing for reciprocation along a first axis in response to a preselected high hydraulic pressure whereby the relative axial force can be applied to a fastener, pneumatic means including a pneumatic piston mounted in a second cylinder in a second housing for reciprocation along a second axis in response to a preselected low pneumatic pressure, said first axis being generally in quadrature with said second axis, intensifier means operable in response to reciprocation of said pneumatic piston at said low pressure to provide said high pressure to said first cylinder, said pneumatic piston including a piston head and a piston rod secured thereto, said intensifier means including a third housing having a third cylinder with said piston rod mounted for reciprocable movement therein, said third housing being generally elongated, said third housing having one end removably fixed to said first housing with said first cylinder being in fluid communication with said first cylinder, said second housing having a first portion defining said second cylinder and a second portion defining a generally elongated handle, connector means engageable with an internal surface within said second cylinder and threadably connected to said third housing at its opposite end to clampingly engage said handle portion between said first housing and said internal surface with the clamping engagement holding said first and third housings to said second housing, said connector means comprising a gland nut having an enlarged flange adapted to engage a shoulder formed within said second cylinder, said second, pneumatic housing being made of a molded plastic material, said first and third housings being made of a different material, pneumatic circuit means comprising air directional valve means having an input adapted to be connected to a source of pneumatic pressure and an output for connection to atmosphere, said valve means having a first condition for actuating said tool to apply the relative axial pulling force and to a second condition for actuating said tool to return, said valve means being supported on a fourth housing of a molded plastic material, said second and fourth housings being connected together and having engaging planar surfaces at their connecting junction.

3. An installation tool, for setting fasteners including a pin and a sleeve by applying a relative axial pulling force between the pin and the sleeve, comprising:

hydraulic means including a hydraulic piston mounted in a first cylinder in a first housing for reciprocation along a first axis in response to a preselected high hydraulic pressure whereby the relative axial force can be applied to a fastener, said hydraulic piston including a piston head and a piston rod secured thereto, said first cylinder having a forward wall with an opening adapted to receive said hydraulic piston rod, pneumatic means including a pneumatic piston mounted in a second cylinder in a second housing for reciprocation along a second axis in response to a preselected low pneumatic pressure, said first axis being generally in quadrature with said second axis, intensifier means operable in response to reciprocation of said pneumatic piston at said low pressure to provide said high pressure to said first cylinder, said pneumatic piston including a piston head and a piston rod secured thereto, said intensifier means including a third housing having a third cylinder with said piston rod mounted for reciprocable movement therein, said third housing being generally elongated, said third housing having one end mechanically fixed to said first housing with said third cylinder being in fluid communication with one side of said first cylinder, said second housing having a first portion defining said second cylinder and a second portion defining a generally elongated handle, connector means connected to said third housing at its opposite end and engageable with an internal surface within said second cylinder to clampingly engage said handle portion between said first housing and said internal surface, said clamping engagement holding said first and third housings to said second housing, said first housing having a filler bore located at the top of said first housing and in fluid communication with said first cylinder near said forward wall, said hydraulic piston head having an annular groove near its forward end such that when said hydraulic piston head is in its forwardmost position against said forward wall said annular groove is generally in axial alignment with said filler bore, said third cylinder having said one end communicating with said first cylinder through a lower bore, said lower bore being generally axially in line with said filler bore, said second axis being substantially in line with said annular groove said filler bore, and said lower bore whereby the flow path between said first and third cylinders is generally along a straight line facilitating filling while inhibiting air entrapment, said installation tool further including pneumatic circuit means comprising operating circuit means for communicating with opposite sides of said first cylinder, air directional valve means having an input adapted to be connected to a source of pneumatic pressure and an output for connection to atmosphere, logic circuit means for connecting said operating circuit means to said valve means and for providing a connection from said valve means to atmosphere, said air directional valve means having a first condition for actuating said tool to apply the relative axial pulling force and to a second condition for actuating said tool to return, and a trigger circuit means selectively actuable to place said air directional valve in said first or said second condition, said valve means being supported in a fourth housing, said second and fourth housings being made of a molded plastic material and having engaging planar surfaces, said logic circuit means being formed by grooves and a plurality of ports in said planar surfaces, said first and third housing being made of a different material, said valve means in said first condition connected to a set of said ports in a first arrangement for connecting one side of said first cylinder to the source of pneumatic pressure and the other side of said first cylinder to atmosphere through said logic circuit means, said valve means in said second condition connected to said ports in a second arrangement for connecting said one side of said first cylinder to atmosphere and said other side of said first cylinder to the source of pneumatic pressure through said logic circuit means, said trigger circuit means being connected to the other side of said first cylinder whereby with said trigger circuit means in said open position said other side of said first cylinder will be communicated to atmosphere and with said trigger circuit means in said closed position said other side of said first cylinder will be communicated to the source of air pressure, dampening means for dampening hydraulic pressure surges resulting from abrupt changes in loading on said hydraulic piston resulting from the application of th pulling force to the fastener, said connector means comprising a gland nut having an enlarged flange adapted to engage a shoulder formed within said second cylinder, said first housing having a forward wall with an opening therethrough, said hydraulic piston having a hydraulic piston rod extending through said forward wall opening, a removable wiper housing threadably secured to an enlarged bore portion of said forward wall opening, said outer anvil being removably secured to said wiper housing and said collet being removably secured to said hydraulic piston rod whereby said wiper housing can be removed and replaced with a different wiper housing adapted to receive a different nose assembly.

4. An installation tool, for setting fasteners including a pin and a sleeve by applying a relative axial pulling force between the pin and the sleeve, comprising:

hydraulic means including a hydraulic piston mounted in a first cylinder in a first housing for reciprocation in response to a preselected high hydraulic pressure whereby the relative axial force can be applied to a fastener, pneumatic means including a pneumatic piston mounted in a second cylinder in a second housing for reciprocation in response to a preselected low pneumatic pressure, intensifier means operable in response to reciprocation of said pneumatic piston at said low pressure to provide said high pressure to said first cylinder, said pneumatic piston including a piston head and a piston rod secured thereto, said intensifier means including a third housing having a third cylinder with said piston rod mounted for reciprocable movement therein, said third housing being generally elongated, said third housing having one end mechanically fixed to said first housing with said third cylinder being in fluid communication with one side of said first cylinder, said second housing having a first portion defining said second cylinder and a second portion defining a generally elongated handle, connector means connected to said third housing at its opposite end and engageable with an internal surface within said second cylinder to clampingly engage said handle portion between said first housing and said internal surface with the clamping engagement holding said first and third housings to said second housing, said second, pneumatic housing being made of a molded plastic material, said first and third housing being made of a different material.

5. The installation tool of claim 4 further including pneumatic circuit means comprising operating circuit means for communicating with opposite sides of said first cylinder, air directional valve means having an input adapted to be connected to a source of penumatic pressure and an output for connection to atmosphere, logic circuit means for connecting said operating circuit means to said valve means and for providing a connection from said valve means to atmosphere, said air directional valve means having a first condition for actuating said tool to apply the relative axial pulling force and to a second condition for actuating said tool to return, and a trigger circuit means selectively actuable to place said air directional valve in said first or said second condition.

6. The installation tool of claim 5 with said valve means in said first condition connected to a set of said ports in a first arrangement for connecting one side of said first cylinder to the source of pneumatic pressure and the other side of said first cylinder to atmophere through said logic circuit means, said valve means in said second condition connected to said ports in a second arrangement for connecting said one side of said first cylinder to atmosphere and said other side of said first cylinder to the source of pneumatic pressure through said logic circuit means.

7. The installation tool of claim 5 with said valve means including a fixed sleeve member and a spool movable in said sleeve between first and second positions for placing said valve means in said first and second conditions, respectively, one side of said spool member being in communication with the source of pneumatic pressure, the other side of said spool member being in communication with said trigger circuit means, restriction means permitting air flow from said one side to said other side at a restricted rate, said trigger circuit means being actuable from a closed position closed to atmosphere to an open position open to atmosphere, said spool having a larger cross section on said other side than on said one side whereby with said trigger circuit means in said open position said spool will be in said first position and with said trigger circuit means in said closed position said spool will be in said second position.

8. The installation tool of claim 7 with said trigger circuit means being connected to the other side of said first cylinder whereby with said trigger circuit means in said open position said other side of said first cylinder will be communicated to atmosphere and with said trigger circuit means in said closed position said other side of said first cylinder will be communicated to the source of air pressure.

9. The installation tool of claim 7 including dampening means for dampening hydraulic pressure surges resulting from abrupt changes in loading on said hydraulic piston resulting from the application of the pulling force to the fastener.

10. An installation tool, for setting fasteners including a pin and sleeve by applying a relative axial pulling force between the pin and the sleeve, comprising:

hydraulic means including a hydraulic piston mounted in a first cylinder in a first housing for reciprocation in response to a preselected high hydraulic pressure whereby the relative axial force can be applied to a fastener, pneumatic means including a pneumatic piston mounted in a second cylinder in a second housing for reciprocation in response to a preselected low pneumatic pressure, intensifier means operable in response to reciprocation of said pneumatic piston at said low pressure to provide said high pressure to said first cylinder, said pneumatic piston including a piston head and a piston rod secured thereto, said intensifier means including a third housing having a third cylinder with said piston rod mounted for reciprocable movement therein, said third housing being generally elongated, said third housing having one end mechanically connected to said first housing with said third cylinder being in fluid communication with one side of said first cylinder, said second housing having a first portion defining said second cylinder and second portion defining a generally elongated handle, connector means connecting said third housing at its opposite end within said second cylinder to clampingly engage said handle portion with the clamping engagement holding said first and third housings to said second housing, dampening means for dampening hydraulic pressure surges resulting from abrupt changes in loading on said hydraulic piston resulting from the application of the pulling force to the fastener, said dampening means located in said third cylinder and comprising an annular seat member having a through opening and a disk supported within said third cylinder for movement to a position covering said seat member opening in response to a pressure surge, said disk having a restriction opening to restrict flow when said disk covers said seat member opening, said disk being in clearance relationship with the side wall of said cylinder such that generally unrestricted fluid flow can occur past said disk to said first cylinder until said disk covers said seat member opening whereby flow is restricted and shock due to the pressure surge is inhibited.

11. The installation tool of claim 10, with the clearance about said disk and said restriction opening are generally of the same area as that of the minimum diameter portion of said seat member opening.

12. The installation tool of claim 11, with said restriction opening being no greater than around one tenth of the area of the minimum diameter portion of said seat member opening.

13. The installation tool of claim 12, with the clearance about said disk and said restriction opening are generally of the same area as that of the minimum diameter portion of said seat member opening.

14. An installation tool, for setting fasteners including a pin and a sleeve by applying a relative axial pulling force between the pin and the sleeve, with a nose assembly having an outer anvil and a movable collet comprising:

hydraulic means including a hydraulic piston mounted in a first cylinder in a first housing for reciprocation in response to a preselected high hydraulic pressure whereby the relative axial force can be applied to a fastener, pneumatic means including a pneumatic piston mounted in a second cylinder in a second housing for reciprocation in response to a preselected low pneumatic pressure, intensifier means operable in response to reciprocation of said pneumatic piston at said low pressure to provide said high pressure to said first cylinder, said pneumatic piston including a piston head and a piston rod secured thereto, said intensifier means including a third housing having a third cylinder with said piston rod mounted for reciprocable movement therein, said third housing being generally elongated, said third housing having one end mechanically fixed to said first housing with said third cylinder being in fluid communication with one side of said first cylinder, said second housing having a first portion defining said second cylinder and a second portion defining a generally elongated handle, connector means connected to said third housing at its opposite end and engageable with an internal surface within said second cylinder to clampingly engage said handle portion between said first housing and said internal surface with the clamping engagement holding said first and third housings to said second housing, said first housing having a forward wall with an opening therethrough, said hydraulic piston having a hydraulic piston rod extending through said forward wall opening, a removable wiper housing threadably secured to an enlarged bore portion of said forward wall opening, said outer anvil being removably secured to said wiper housing and said collet being removably secured to said hydraulic piston rod whereby said wiper housing can be removed and replaced with a different wiper housing adapted to receive a different nose assembly.

15. The installation tool of claim 14 with said forward wall opening communicating with said first cylinder and having a seal means located in said forward wall opening to provide a hydraulic seal with said hydraulic piston rod, said wiper housing including an annular wiper ring located in a bore through which said hydraulic piston rod extends to block dirt and dust from said seal means.

16. The installation tool of claim 15 with said wiper housing being removable to facilitate access to and installation of said seal means through said forward wall opening.

17. An installation tool, for setting fasteners including a pin and a sleeve by applying a relative axial pulling force between the pin and the sleeve, comprising:

hydraulic means including hydraulic piston mounted in a first cylinder in a first housing for reciprocation along a first axis in response to a preselected high hydraulic pressure whereby the relative axial force can be applied to a fastener, said hydraulic piston including a piston head and a piston rod secured thereto, said first cylinder having a forward wall with an opening adapted to receive said hydraulic piston rod, pneumatic means including a pneumatic piston mounted in a second cylinder in a second housing for reciprocation along a second axis in response to a preselected low pneumatic pressure, said first axis being generally in quadrature with said second axis, intensifier means operable in response to reciprocation of said pneumatic piston at said low pressure to provide said high pressure to said first cylinder, said pneumatic piston including a piston head and a piston rod secured thereto, said intensifier means including a third housing having a third cylinder with said piston rod mounted for reciprocable movement therein, said third housing being generally elongated, said third housing having one end mechanically fixed to said first housing with said third cylinder being in fluid communication with one side of said first cylinder, said second housing having a first portion defining said second cylinder and a second portion defining a generally elongated handle, connector means connected to said third housing at its opposite end and engageable with an internal surface within said second cylinder to clampingly engage said handle portion between said first housing and said internal surface, said clamping engagement holding said first and third housings to said second housing, said first housing having a filler bore located at the top of said first housing and in fluid communication with said first cylinder near said forward wall, said hydraulic piston head having an annular groove near its forward end such that when said hydraulic piston head is in its forwardmost position against said forward wall said annular groove is generally in axial alignment with said filler bore whereby filling of said first cylinder is facilitated while inhibiting air entrapment.

18. The installation tool of claim 17 with said third cylinder having said one end communicating with said first cylinder through a lower bore, said lower bore being generally axially in line with said filler bore, said second axis being substantially in line with said annular groove said filler bore, and said lower bore whereby the flow path between said first and third cylinders is generally along a straight line.

19. An installation tool, for setting fasteners including a pin and a sleeve by applying a relative axial pulling force between the pin and the sleeve, comprising:

hydraulic means including a hydraulic piston mounted in a first cylinder in a first housing for reciprocation along a first axis in response to a preselected high hydraulic pressure whereby the relative axial force can be applied to a fastener, pneumatic means including a pneumatic piston mounted in a second cylinder in a second housing for reciprocation along a second axis in response to a preselected low pneumatic pressure, said first axis being generally in quadrature with said second axis, intensifier means operable in response to reciprocation of said pneumatic piston at said low pressure to provide said high pressure to said first cylinder, said pneumatic piston including a piston head and a piston rod secured thereto, said intensifier means including a third housing having a third cylinder with said piston rod mounted for reciprocable movement therein, said third housing being generally elongated, said third housing having one end threadably connected to said first housing with said first cylinder being in fluid communication with said first cylinder, said second housing having a first portion defining said second cylinder and a second portion defining a generally elongated handle, connector means engageable with an internal surface within said second cylinder and threadably connected to said third housing at its opposite end to clampingly engage said handle portion between said first housing and said internal surface with the clamping engagement holding said first and third housings to said second housing, said connector means comprising a gland nut having an enlarged flange adapted to engage a shoulder formed within said second cylinder, said second, pneumatic housing being made of a molded plastic material, said first and third housings being made of a different material.

20. The installation tool of claim 19 with said gland nut having a central bore adapted to receive said pneumatic piston rod, said gland nut bore being of a diameter smaller than that of said third cylinder whereby said pneumatic piston rod will be generally held out of engagement with the wall of said third cylinder.

* * * * *

UNITED STATES PATENT AND TRADEMARK OFFICE

CERTIFICATE OF CORRECTION

PATENT NO. : 4,580,435

DATED : April 8, 1986

INVENTOR(S) : Gary L. Port, Michael J. Himes & John J. Kaelin

It is certified that error appears in the above-identified patent and that said Letters Patent is hereby corrected as shown below:

Column 14, line 51, delete "th" and substitute therefor --the--.
Column 15, line 34, delete "housing" and substitute therefor --housings--.
Column 15, line 41, delete "penumatic" and substitute therefor --pneumatic--.
Column 15, line 57, delete "atmophere" and substitute therefor --atmosphere--.
Column 16, line 30, after "and" insert --a--.
Column 16, line 55, after "and" insert --a--.

Signed and Sealed this

Eighteenth Day of November, 1986

*Attest:*

DONALD J. QUIGG

*Attesting Officer* *Commissioner of Patents and Trademarks*